US011002270B2

(12) United States Patent
West

(10) Patent No.: US 11,002,270 B2
(45) Date of Patent: May 11, 2021

(54) COOLING METHODS FOR ELECTRICALLY OPERATED DIAPHRAGM PUMPS

(71) Applicant: Ingersoll-Rand Industrial U.S., Inc., Davidson, NC (US)

(72) Inventor: Joshua D. West, Mooresville, NC (US)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 690 days.

(21) Appl. No.: 15/489,512

(22) Filed: Apr. 17, 2017

(65) Prior Publication Data

US 2017/0298930 A1 Oct. 19, 2017

Related U.S. Application Data

(60) Provisional application No. 62/323,884, filed on Apr. 18, 2016.

(51) Int. Cl.
*F04B 53/08* (2006.01)
*F04B 43/02* (2006.01)
(Continued)

(52) U.S. Cl.
CPC ..... *F04B 53/08* (2013.01); *F04B 43/026* (2013.01); *F04B 43/04* (2013.01); *F04B 53/10* (2013.01)

(58) Field of Classification Search
CPC ..... F04B 43/02; F04B 43/023; F04B 43/025; F04B 43/04; F04B 43/14; F04B 45/04;
(Continued)

(56) References Cited

U.S. PATENT DOCUMENTS 2,930,324 A * 3/1960 Toulmin, Jr. ..... F04B 43/023 417/413.1
3,461,808 A * 8/1969 Hanson ..... F04B 43/0054 417/479
(Continued)

FOREIGN PATENT DOCUMENTS

DE 2815901 A1 * 10/1978 ..... F04B 9/113
DE 3719460 A1 1/1988
(Continued)

OTHER PUBLICATIONS

Defintion of ANGLED, downloaded Feb. 1, 2020, URL: https://www.lexico.com/en/definition/angled (2020).*
(Continued)

*Primary Examiner* — Devon C Kramer
*Assistant Examiner* — Thomas Fink
(74) *Attorney, Agent, or Firm* — Edell, Shapiro & Finnan, LLC

(57) ABSTRACT

A diaphragm pump includes motor that drives an armature in a reciprocating linear motion. A first diaphragm is coupled to a first end of the armature, the first diaphragm positioned in a first pumping chamber and configured to pump fluid into and out of the first pumping chamber in response to the reciprocating linear motion of the armature. A cooling intake valve and a cooling exhaust valve are in operative communication with the first diaphragm, wherein as the armature advances to flex the first diaphragm to decrease a volume of the first pumping chamber, the first diaphragm draws ambient air behind the first diaphragm through the cooling intake valve, and wherein as the armature reverses course to cause the first diaphragm to increase the volume of the first pumping chamber, the first diaphragm forces ambient air out of the first pumping chamber through the cooling exhaust valve.

15 Claims, 4 Drawing Sheets

(51) Int. Cl.
*F04B 43/04* (2006.01)
*F04B 53/10* (2006.01)

(58) Field of Classification Search
CPC .... F04B 45/041; F04B 45/043; F04B 45/047; F04B 53/08
See application file for complete search history.

(56) References Cited

U.S. PATENT DOCUMENTS

| | | | | | |
|---|---|---|---|---|---|
| 3,936,237 | A * | 2/1976 | Chattopadhayay | F04B 45/041 417/311 |
| 3,954,352 | A * | 5/1976 | Sakai | F04B 45/041 417/244 |
| 4,137,020 | A * | 1/1979 | Ito | F02B 67/04 417/470 |
| 4,897,890 | A * | 2/1990 | Walker | A47C 27/082 137/596 |
| 5,013,223 | A * | 5/1991 | Takahashi | F04B 17/042 310/12.04 |
| 5,742,954 | A | 4/1998 | Idland | |
| 6,280,149 | B1 | 8/2001 | Able et al. | |
| 6,295,662 | B1 * | 10/2001 | Idland | A61H 33/6047 4/492 |
| 9,441,623 | B2 * | 9/2016 | Ishii | F04B 43/0054 |
| 2014/0042832 | A1 * | 2/2014 | Wang | H02K 33/12 310/12.21 |

FOREIGN PATENT DOCUMENTS

| | | | | |
|---|---|---|---|---|
| DE | 10013797 | B4 | 10/2001 | |
| DE | 10138070 | C2 | 5/2003 | |
| DE | 102004042944 | A1 | 3/2006 | |
| DE | 102010038873 | A1 | 2/2012 | |
| DE | 202014000922 | U1 | 3/2014 | |
| EP | 0144609 | A2 * | 6/1985 | F04B 43/023 |
| EP | 1515044 | A1 | 3/2005 | |
| EP | 2543884 | A1 | 1/2013 | |
| EP | 2607699 | A1 | 6/2013 | |
| EP | 2634429 | A1 | 9/2013 | |
| EP | 2639455 | A1 | 9/2013 | |
| JP | S54113506 | A | 9/1979 | |
| JP | S54113506 | A1 * | 9/1979 | |
| JP | S55-54686 | A | 4/1980 | |
| JP | S5554686 | A | 4/1980 | |
| JP | 2002285968 | A1 * | 10/2002 | |
| JP | 2005282499 | A | 10/2005 | |
| KR | 1020140011382 | A1 | 1/2014 | |
| KR | 20160109671 | A | 9/2016 | |

OTHER PUBLICATIONS

Exam Report dated Feb. 20, 2019; GB 1706128.4; Filed Apr. 18, 2017.
Search and Exam Report dated Sep. 19, 2017 from European Patent Application No. GB1706128.4, filed Apr. 18, 2017.
Search and Exam Report dated Sep. 29, 2017 from European Patent Application No. GB1706125.0, filed Apr. 18, 2017.
Exam Report dated Mar. 13, 2019; GB 1706125.0; Filed Apr. 18, 2017.
Exam Report dated Mar. 6, 2018 from German Patent Application No. DE102017108196.8, filed Apr. 18, 2017.
Exam Report dated Mar. 16, 2018 from German Patent Application No. DE102017108203.4, filed Apr. 18, 2017.
Office Action dated Jul. 27, 2018; 201710254244.6; Filed Apr. 18, 2017.

* cited by examiner

COOLING METHODS FOR ELECTRICALLY OPERATED DIAPHRAGM PUMPS

CROSS REFERENCE TO RELATED APPLICATION

This application claims priority to U.S. Provisional Patent Application No. 62/323,884, filed Apr. 18, 2016, the disclosure of which is hereby incorporated entirely herein by reference.

BACKGROUND

Technical Field

The present disclosure relates to diaphragm pumps and other positive displacement pumps utilizing the reciprocating action of a flexible diaphragm.

State of the Art

A diaphragm pump is generally described as a positive displacement pump that uses the reciprocating action of a flexible diaphragm and corresponding valves in fluidic communication with the diaphragm to pump a fluid.

The diaphragm is typically sealed to create a pump chamber. The flexing of the diaphragm can cause the volume of the pump chamber to increase and decrease. As the volume increases, the fluid to-be-pumped is introduced to the chamber and as the volume decreases, the fluid to-be-pumped is expelled from the chamber. This pattern is repeatable, thus creating the reciprocating pumping action of the pump.

However, the repetitive nature of the reciprocating action can result in inefficiencies. There is thus a need to improve the efficiency of diaphragm pumps or other positive displacement pumps.

SUMMARY

The present disclosure relates to diaphragm pumps and other positive displacement pumps utilizing the reciprocating action of a flexible diaphragm.

An aspect of the present disclosure includes a diaphragm pump comprising: a motor that drives an armature in a reciprocating linear motion, the armature having a first end; a first diaphragm coupled to the first end of the armature, the first diaphragm positioned in a first pumping chamber, the first diaphragm configured to pump fluid into and out of the first pumping chamber in response to the reciprocating linear motion of the armature; a cooling intake valve in operative communication with the first diaphragm; and a cooling exhaust valve in operative communication with the first diaphragm, wherein as the armature advances to flex the first diaphragm to decrease a volume of the first pumping chamber to pump fluid therefrom, the first diaphragm draws ambient air into the first pumping chamber behind the first diaphragm through the cooling intake valve, and wherein as the armature reverses course to cause the first diaphragm to increase the volume of the first pumping chamber to pump fluid therein, the first diaphragm forces ambient air out of the first pumping chamber behind the first diaphragm through the cooling exhaust valve.

Another aspect of the present disclosure includes fins coupled to the motor.

Another aspect of the present disclosure includes wherein the cooling exhaust valve is angled toward the fins.

Another aspect of the present disclosure includes wherein the cooling exhaust valve directs the ambient air exiting therefrom over the fins.

Another aspect of the present disclosure includes a motor mount configured to support the motor in the pump, wherein the cooling intake valve and the cooling exhaust valve are configured in the motor mount.

Another aspect of the present disclosure includes a plurality of cooling intake valves and a plurality of cooling exhaust valves, each of the cooling intake valves having a corresponding cooling exhaust valve.

Another aspect of the present disclosure includes a second diaphragm coupled to a second end of the armature, the second diaphragm positioned in a second pumping chamber, the second diaphragm configured to pump fluid into and out of the second pumping chamber in response to the reciprocating linear motion of the armature, a cooling intake valve and a cooling exhaust valve in operative communication with the second diaphragm, wherein as the armature advances to flex the second diaphragm to decrease a volume of the second pumping chamber to pump fluid therefrom, the second diaphragm draws ambient air into the second pumping chamber behind the second diaphragm through the cooling intake valve, and wherein as the armature reverses course to cause the second diaphragm to increase the volume of the second pumping chamber to pump fluid therein, the second diaphragm forces ambient air out of the second pumping chamber behind the second diaphragm through the cooling exhaust valve.

Another aspect of the present disclosure includes wherein the first and second pumping chambers function inversely to one another.

Another aspect of the present disclosure includes wherein the fins are oriented lengthwise along a length of the motor.

Another aspect of the present disclosure includes wherein the fins are configured with a gap between neighboring fins and the cooling exhaust valve forces the ambient air exiting therefrom into the gaps.

Another aspect of the present disclosure includes a diaphragm pump comprising: a motor that drives an armature in a reciprocating linear motion, the armature having a first end; a first diaphragm coupled to the first end of the armature, the first diaphragm positioned in a first pumping chamber, the first diaphragm configured to pump fluid into and out of the first pumping chamber in response to the reciprocating linear motion of the armature; a manifold having a surface thereof in direct contact with at least a portion of the motor, wherein the fluid pumped into and out of the first pumping chamber passes through the manifold to effectuate heat transfer with the motor.

Another aspect of the present disclosure includes wherein the manifold directly contacts the motor at a plurality of locations on the motor.

Another aspect of the present disclosure includes a method of cooling a diaphragm pump, the method comprising: providing a motor that drives an armature in a reciprocating linear motion to drive a diaphragm in a pumping chamber; providing evaporative fins on an exterior surface of the motor; drawing ambient air into the pumping chamber behind the diaphragm; forcing the ambient air from the pumping chamber by the diaphragm; blowing the ambient air across the fins to cool the motor by forced convection.

Another aspect of the present disclosure includes orienting the fins lengthwise along a length of the motor with a gap between neighboring fins.

Another aspect of the present disclosure includes forcing the ambient air exiting the pumping chamber into the gap between neighboring fins.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

Figure 1:
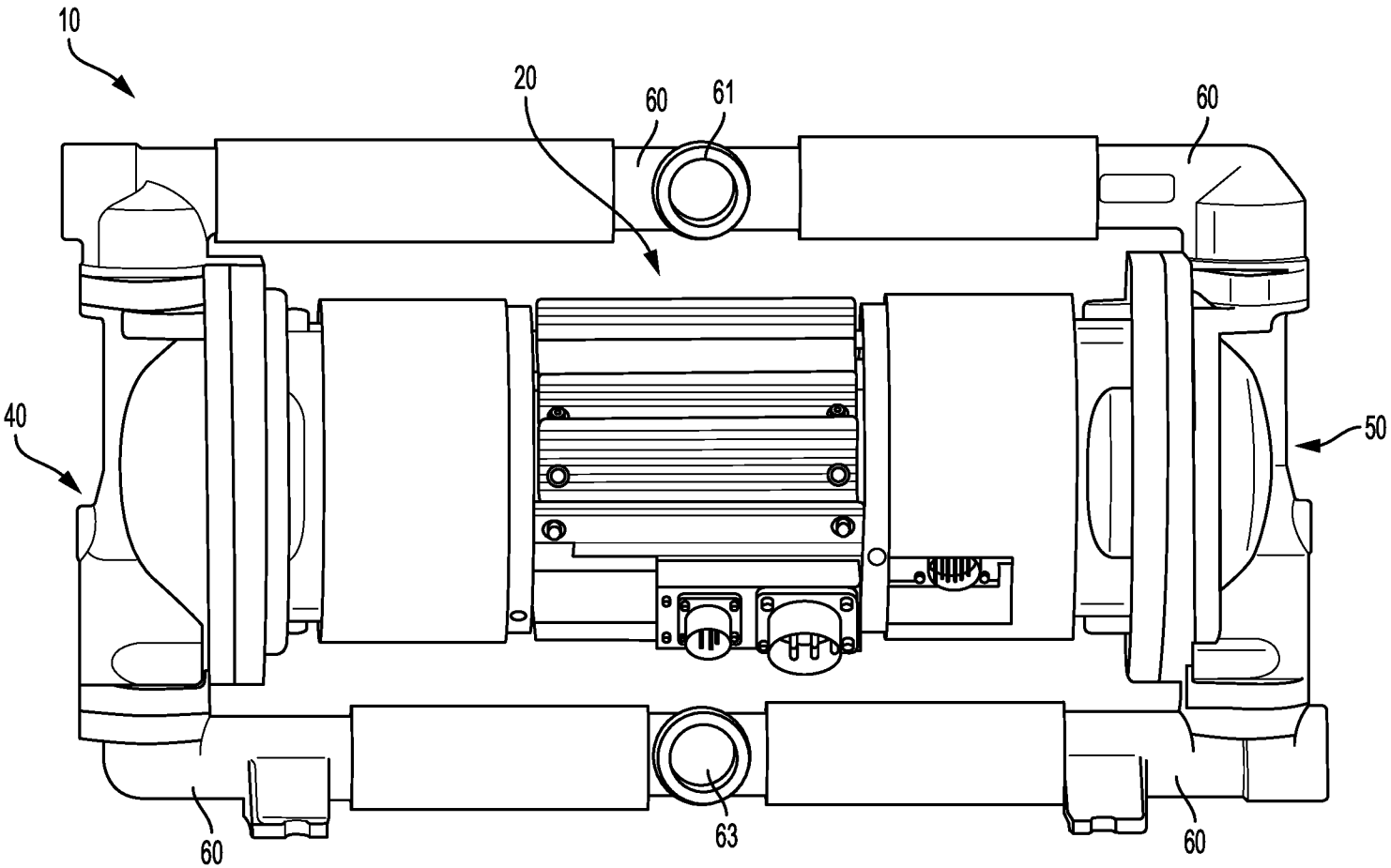
FIG. 1 is a side view of an illustrative embodiment of a linear motor double diaphragm pump in accordance with the present disclosure.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of a double diaphragm pump 10. These embodiments may each comprise various structural and functional components that complement one another to provide the distinct functionality and performance of the pump 10, the particular structure and function thereof to be described in greater detail herein.

Referring to the drawings, FIGS. 1-4 depict illustrative embodiments of a double diaphragm pump 10 in accordance with the present disclosure. Embodiments of the pump 10 may comprise, among other components, a motor 20, an armature 30, opposing pumping chambers 40 and 50, and a corresponding manifold 60 having one or more inlets and outlets positioned therein, as needed.

Embodiments of the pump 10 may comprise a motor 20. The motor 20 may be, for example, a linear electro-magnetic motor having a stator 22. The stator 22 may comprise a coil set (not depicted) configured to be an electrical conductor, the coil set being, for example, a series of wire coils in the shape of a coil, spiral, helix, or other cylindrical-type shape, through which an electric current may pass. With the stator 22 being coupled to an electrical power source through the electric port 25, electrical current may pass through the coil set, the coil set may function as an electromagnetic conductor to generate a magnetic field. The coil set may be considered the winding(s) of the electromagnetic conductor and the coil set may have one or more windings. These windings may be inductively or magnetically coupled. The center of the winding(s) may define the magnetic axis of the conductor. The ends of the winding(s) of the coil set may be coupled to one or more circuits for electrical power. The number of windings or coils in the coil set, the number of separate passes of wire in the windings or coil set, and/or the given current passing through the windings or the coil set may be adjusted to change, alter, or amend the resulting magnetic field.

The linear magnetic motor may have, for example, a corresponding magnetic armature 30 that comprises one or more magnets in series. For example, the magnetic armature 30 may comprise a series of permanent magnets aligned in a linear, or shaft-like, configuration, wherein the magnets may be lined up with one another end-to-end in a line. The magnetic armature 30 may have an exterior casing, or sleeve, in which the magnets are positioned. For example, the magnetic armature 30 may have a cylindrical shape, wherein the magnetic armature 30 may have an axis defined by the diameter of the magnets and the collective linear length of the magnets placed end-to-end. The axis of the magnetic armature 30 may be configured to align with the magnetic axis of the stator 22, such that the magnetic armature 30 is coaxial with the stator 22. The magnetic armature 30 may therefore be configured to be set within the windings or coils of the coil set and be responsive to the magnetic forces generated by the coil set within the stator 22. In this way, the magnetic armature 30 may be configured to pass back and forth in a linear, reciprocal motion through the interior diameter of the stator 22 in response to the magnetic forces of the coil set. Such a configuration may generate a 360-degree magnetic flux, wherein the magnetic armature 30 moves in a linear, back and forth motion, through the stator 22 in response to the magnetic forces generated by the coil set without physically contacting the stator 22.

In the alternative, the motor 20 may be, for example, a conventional electric motor, such as a direct current, brushless type, reversible motor. The electric motor may be configured to drive the armature 30 in a back-and-forth reciprocating motion to thereby drive the operation of the diaphragms 42 and 52, to be described herein in greater detail. The electric motor may have a rotor spindle having permanent magnets thereon, the rotor spindle being mounted for rotational movement and functioning as a drive member that drives the armature 30 back and forth in a linear manner along its axis in response to electromagnetic forces generated by the fixed stator of the electric motor. The rotor spindle and the armature 30 may be configured with matching threads to cooperate with one another. Other conventional electric motors may operate to provide power from its output shaft through a gear train or mechanism to provide the reciprocal back-and-forth linear motion of the armature 30.

Further in the alternative, the motor 20 may be, for example, a conventional pneumatic or hydraulic motor that is configured to convert fluid energy into linear energy to provide linear back-and-forth motion to the armature 30.

Embodiments of the pump 10 may comprise the motor 20 being coupled to a motor mount 26, wherein the motor mount 26 may serve to support the motor in its proper orientation and position with respect to the other components of the pump 10, and in particular the armature 30.

Furthermore, the armature 30 may be supported by a sleeve, bushing, bearing, or positioner 28 that may be configured to maintain the orientation and position of the armature 30 with respect to the motor 20. The positioner 28 may be configured to maintain the position of the armature 30 and yet permit the back and forth linear translation of the armature 30. As described, one or more positioners 28 may be configured within the motor 20 to support the armature 30. Further, one or more positioners may be positioned on either side of the motor 20 at any point along the axial length of the armature 30. The armature 30 may therefor extend beyond an end of the motor 20 on one or more sides of the motor 20. In particular, the armature 30 may have a first end 32 and a second end 34 that oppose one another and extend beyond the motor 20 on either side of the motor 20.

Embodiments of the pump 10 may comprise one or more spacers 80 positioned between the motor mounts 26 and the first and second pumping chambers, 40 and 50, to be described in greater detail herein. The spacers 80 may be configured to properly space the first and second pumping chambers, 40 and 50, from the motor 20 to provide the armature 30 with the desired stroke length, or the like. Moreover, the size and shape of the spacers 80 may be adjusted to accommodate for the desired stroke length or power of the motor 20 and/or the pump 10. The stroke length of the pump 10 may be determined by the axial length of the armature 30.

Embodiments of the pump 10 may comprise the first and second pumping chambers, 40 and 50, being releasably coupled to the motor mounts 26 themselves. In other words, embodiments of the pump 10 may comprise the motor mount 26 on either side of the motor 20 being coupled to the respective caps, 44 and 54, with the first and second diaphragms, 42 and 52, respectively, being positioned therebetween, which will be described in greater detail herein. Having the motor mounts 26 function as not only the support for the motor 20 but also as the retaining member or coupling member to which the caps, 44 and 54, may be coupled, may greatly reduce the size of the pump 10.

Embodiments of the pump 10 may further comprise a first pumping chamber 40. The first pumping chamber 40 may comprise a first diaphragm 42 and a first cap 44 defining therebetween a first fluid chamber 46. The first diaphragm 42 may be a flexible diaphragm capable of repeatedly flexing and/or bending in response to input, such as force. The first diaphragm 42 may be releasably coupled to the first end 32 of the armature 30, such as, for example, by a fastener 45. The diaphragm 42 may be operatively coupled, either directly or indirectly, to the first end of the armature 30, such that the back and forth movement of the armature 30, as described herein, may serve to flex the diaphragm 42 in a similar back and forth motion within, or in communication with, the first fluid chamber 46. The first cap 44 may be releasably coupled to the pump 10, and in particular may be coupled to components of the pump so as to be configured to functionally communicate with the first diaphragm 42. The first cap 44 may serve to oppose the first diaphragm 42 and define the first fluid chamber 46 therebetween. The first fluid chamber 46 may be configured to house a fluid therein, on which the diaphragm 42 may operate, or otherwise work, to create a fluid flow and/or pressure on the fluid. In other words, the fluid chamber 46 may comprise an inlet check valve 47 and an outlet check valve 49 that operate to direct a flow of fluid in and out of the fluid chamber 46 in response to the movement or displacement of the diaphragm 42. The inlet check valves 47 and an outlet check valves 49 may be ball valves, flap valves, or other similar valves that open and close alternately to fill chambers and restrict or otherwise block back flow. The inlet check valves 47 and an outlet check valves 49 may be reversed, or flip-flopped, in their respective configuration on the second pumping chamber 40, as desired for a particular flow configuration.

As the armature 30 exerts force to flex the diaphragm 42 toward the cap 44, the diaphragm 42 may decrease the volume within the fluid chamber 46 to thereby force or displace at least a portion of the fluid within the fluid chamber 46 to close the inlet check valve 47 and open the outlet check valve 49 so that the fluid may exit the outlet check valve 49 and pass into the manifold 60. Similarly, as the armature 30 exerts force to retract the diaphragm 42 away from the cap 44, the diaphragm 42 may increase the volume within the fluid chamber 46 to thereby create a vacuum within the fluid chamber 46 that may serve to open the inlet check valve 47 and close the outlet check valve 49 so that the fluid in the manifold 60 may pass through the inlet check valve 47 and enter into the fluid chamber 46. With more of the fluid in the fluid chamber 46, the armature 30 may be set to repeat the foregoing steps by repeatedly exerting force on the diaphragm 42 to flex the diaphragm 42 back and forth in repetition, toward and away from the cap 44, as described, to cause the fluid to repeatedly enter and exit the fluid chamber 46. In this way, the armature 30 and the first pumping chamber 40 function as one half of the diaphragm pump 10 to pump a fluid through the pump 10, the manifold 60, and toward a desired destination.

Embodiments of the pump 10 may further comprise a second pumping chamber 50. The second pumping chamber 50 may comprise a second diaphragm 52 and a second cap 54 defining therebetween a second fluid chamber 56. The second diaphragm 52 may be a flexible diaphragm capable of repeatedly flexing and/or bending in response to input, such as force. The second diaphragm 52 may be releasably coupled to the second end 34 of the armature 30, such as, for example, by the fastener 45. The second diaphragm 52 may be operatively coupled, either directly or indirectly, to the second end 34 of the armature 30, such that the back and forth movement of the armature 30, as described herein, may serve to flex the second diaphragm 52 in a similar back and forth motion within, or in communication with, the second fluid chamber 56. The second cap 54 may be releasably coupled to the pump 10, and in particular may be coupled to components of the pump 10 so as to be configured to functionally communicate with the second diaphragm 52. The second cap 54 may serve to oppose the second diaphragm 52 and define the second fluid chamber 56 therebetween. The second fluid chamber 56 may be configured to house a fluid therein, on which the diaphragm 52 may operate, or otherwise work, to create a fluid flow and/or pressure on the fluid. In other words, the fluid chamber 56 may comprise an inlet check valve 57 and an outlet check valve 59 that operate to direct a flow of fluid in and out of the fluid chamber 56 in response to the movement or displacement of the diaphragm 52. The inlet check valves 57 and an outlet check valves 59 may be ball valves, flap valves, or other similar valves that open and close alternately to fill chambers and restrict or otherwise block back flow. The inlet check valves 57 and an outlet check valves 59 may be reversed, or flip-flopped, in their respective configuration on the second pumping chamber 50, as desired for a particular flow configuration.

As the armature 30 exerts force to flex the diaphragm 52 toward the cap 54, the diaphragm 52 may decrease the volume within the fluid chamber 56 to thereby force or displace at least a portion of the fluid within the fluid chamber 56 to close the inlet check valve 57 and open the outlet check valve 59 so that the fluid may exit the outlet check valve 59 and pass into the manifold 60. Similarly, as the armature 30 exerts force to retract the diaphragm 52 away from the cap 54, the diaphragm 52 may increase the volume within the fluid chamber 56 to thereby create a vacuum within the fluid chamber 46 that may serve to open the inlet check valve 57 and close the outlet check valve 59 so that the fluid in the manifold 60 may pass through the inlet check valve 57 and enter into the fluid chamber 56. With more of the fluid back in the fluid chamber 56, the armature 30 may be set to repeat the foregoing steps by repeatedly exerting force on the diaphragm 52 to flex the diaphragm 52 back and forth in repetition, toward and away from the cap 54, as described, to cause the fluid to repeatedly enter and exit the fluid chamber 56. In this way, the armature 30 and the second pumping chamber 50 function as one half of the diaphragm pump 10 to pump a fluid through the pump 10, the manifold 60, and toward a desired location.

Embodiments of the pump 10 may comprise the first and second pumping chambers, 40 and 50, working in tandem to displace, or otherwise pump, a fluid based on the reciprocating action generated from a magnetically driven, linear double-diaphragm pump 10, wherein the first and second pumping chambers, 40 and 50, are configured to work on opposing ends of the armature 30 that is linearly translated back and forth in response to forces exerted thereon by the motor 20. In other words, as the magnetic armature 30 moves back and forth to exert force to flex the diaphragm 42 towards the cap 44 to decrease the volume of the first fluid chamber 46, the magnetic armature 30 concurrently flexes the diaphragm 52 away from the cap 54 to increase the volume of the second fluid chamber 56. In like manner, as the magnetic armature 30 exerts force to flex the diaphragm 42 away from the cap 44 to increase the volume of the first fluid chamber 46, the magnetic armature 30 concurrently flexes the diaphragm 52 toward the cap 54 to decrease the volume of the second fluid chamber 56. As a result, the magnetic armature 30, in response to input from the motor 20, may move back and forth in a linear manner to contemporaneously exert opposite and reciprocating forces on each of the first and second pumping sections, 40 and 50. In this way, the pump 10 may simultaneously move fluid through, into, out of, within, or by way of each of its pumping sections 40 and 50, as well as the manifold 60, as the case may be.

Embodiments of the pump 10 may comprise a manifold 60 in operative communication with the fluid within the pump 10. The manifold 60 may comprise one or more fluid inlet/outlets 70. The manifold 60 may be configured to fluidically couple the one or more inlet/outlets 70 to the first and second pumping chambers, 40 and 50, and vice versa. In other words, the manifold 60 may comprise the tubing and/or piping that directs the flow of the fluid being processed and worked upon by the pump 10 through each of the pumping chambers, 40 and 50, and into and out of the pump 10. The size and shape of the manifold 60 may be adapted according to the needs of the pump 10. The manifold 60 may be configured to receive either, or both, of a pressurized or non-pressurized source of fluid.

Embodiments of the pump 10 may comprise a control unit 12 and associated control electronics 14. For example, the control unit 12 may be a controller comprising a processor (CPU), circuit board, internal memory, encoder, software, control algorithms, inputs, outputs, and other electrical components as needed to direct the electrical operations and control electronics 14 of the pump 10. Further in example, the associated control electronics 14 may further comprise sensors, gauges, valves, regulators, transducers, solenoids, controllers, wireless communications, and the like for measuring and controlling fluid flow through the pump 10, counting pump cycles, controlling motor speed and power, measuring flow rate, measuring and controlling fluid pressure, detecting leaks, measuring and sensing end of stroke, offsetting the stroke length, measuring and controlling current flow through the motor 20, and balancing the fluid flow through the pump 10, among other important electrically-based operational and control aspects of the pump 10. The control unit 12 may be configured to coordinate the operations of each component of the control electronics 14 to achieve, control, and/or alter any of the foregoing operational aspects of the pump 10. Alternatively, each of the components of the control electronics 14 may be configured to communicate directly with one or more corresponding components, as needed, to perform the desired operations of the pump 10. Further in the alternative, each of the components of the control electronics 14 may be configured to communicate with the control unit 12 as well as directly with one or more corresponding components, as needed, to perform the desired operations of the pump 10.

Figure 2:
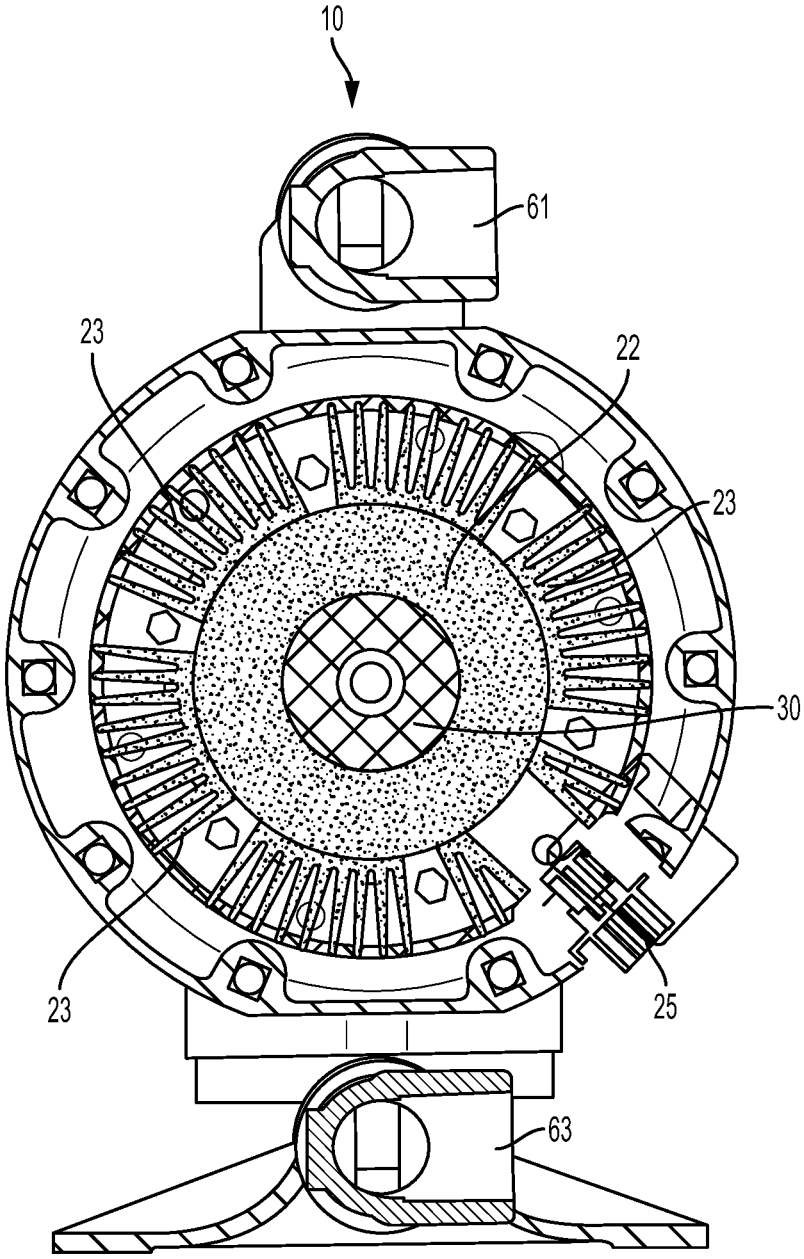
FIG. 2 is a cross-sectional end view of the linear motor double diaphragm pump depicted in FIG. 1 in accordance with the present disclosure.
Figure 3:
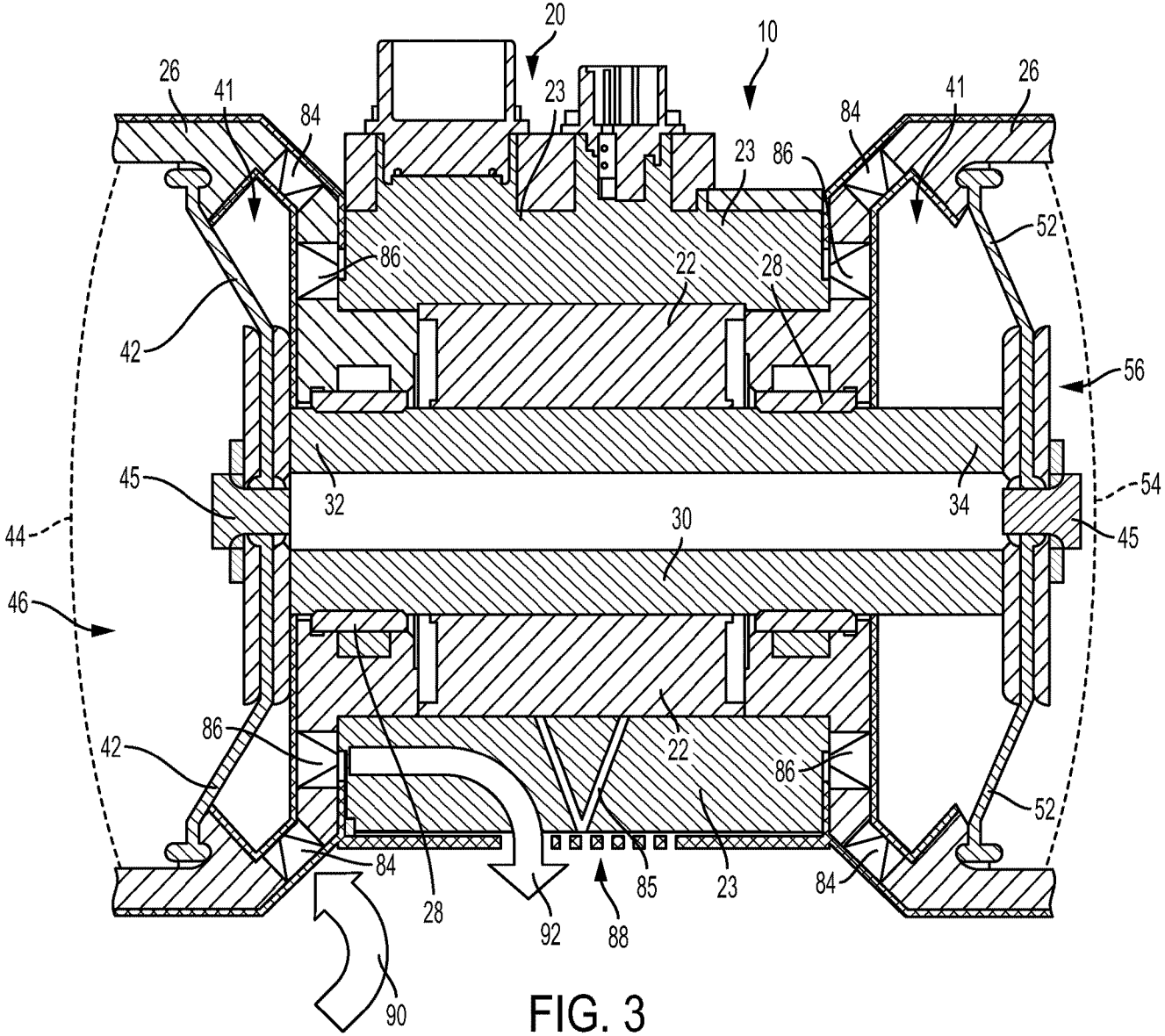
FIG. 3 is a cross-sectional side view of an illustrative embodiment of a linear motor double diaphragm pump in accordance with the present disclosure.

With regard to FIGS. 2 and 3, embodiments of the pump 10 may comprise the motor 20 having one or more heat dissipation fins 23 in thermal communication therewith, and in particular with the stator to dissipate heat away from the coil windings. The heat dissipation fins 23 may be configured in a pattern about the exterior of the motor 20 to draw heat outward and/or away from the coil windings. In electric or electromagnetic motors 20, heat may be generated within the motor 20 due to the electric current passing through the metal windings. The heat dissipation fins 23 may therefore be coupled to the motor 20, the motor mount 26, or other components of the pump 10 so that the fins 23 are in thermal communication with the motor 20 to function as a heat sink to draw heat away from the motor 20. The heat dissipation fins 23 may be positioned about the entire exterior of the motor 20 in a 360-degree configuration. The fins 23 may extend in an outward radial pattern away from the motor 20. The fins 23 may define a gap or space between neighboring fins 23, wherein ambient air may reside, pass, or flow to draw out heat from the fins 23 and into the ambient air or atmosphere. The fins 23 may be made of metal, such as heat conductive metals like aluminum or copper. In such a configuration, the base of each of the fins 23 that is in functional thermal contact with the motor 20 may draw heat out and away from the motor 20. The heat will then travel outward toward a cooler distal end of each of the fins 23. As the heat transfers from the base of the fin 23 to the distal end of the fin 23, the ambient air between the fins 23 may draw out the heat into the ambient air to thereby cool the fins 23 and permit the fins 23 to continuously draw more heat away from the motor 20.

With regard to FIG. 3, embodiments of the pump 10 may comprise one or more convective cooling features, such as cooling valves 84 and 86. The valves 84 and 86 may function as heat transfer or cooling features that assist the transfer of heat away from the motor 20 and to the ambient air. The valve 84 may be an intake valve that is positioned somewhere on the motor mount 26 and/or on the caps 44 or 54 and is in functional communication with the diaphragms 42 or 52 and the respective pumping chambers 40 and 50. For example, the valve 84 may be positioned to fluidically communicate with each of the pumping chambers 40 and 50. In other words, one valve 84 may be configured to fluidically communicate with the pumping chamber 40, while another valve 84 may be configured to fluidically communicate with the pumping chamber 50. In like manner, the valve 86 may be an exhaust valve that is positioned somewhere on the motor mount 26 and/or on the caps 44 or 54 and is in functional communication with the diaphragms 42 or 52 and the respective pumping chambers 40 and 50. For example, the valve 86 may be positioned to fluidically communicate with each of the pumping chambers 40 and 50. In other words, one valve 86 may be configured to fluidically communicate with the pumping chamber 40, while another valve 86 may be configured to fluidically communicate with the pumping chamber 50.

While the primary purpose of the diaphragm 42 to is pump the fluid through the pumping chamber 40, and likewise for the diaphragm 52 and pumping chamber 50, embodiments of the pump 10 may be configured such that a secondary purpose of the diaphragms 42 and 52 may be to pull ambient air (as indicated by the arrow 90) external to the pump 10, through the valve 84 and into the respective pumping chambers 40 and 50, but on the backside or opposite side of the respective diaphragm 42 and 52 from the fluid, and thereafter dispel the ambient air (out of the pumping chambers 40 and 50 through the valve 86 (as indicated by the arrow 92).

In particular, take for example the diaphragm 42 and the respective pumping chamber 40. As the diaphragm 42 flexes toward the cap 44 to reduce the volume of the pumping chamber 40 on the fluid side, in response to the movement of the armature 30, the fluid residing in the pumping chamber 40 is expelled from the pumping chamber 40, due to increased pressure from decreasing volume, through one of the check valves 47 or 49 (depending on the flow direction of the fluid) and into the manifold 60. Concurrently therewith, behind the diaphragm 42, on the opposite side 41 of the diaphragm 42 from the fluid, a vacuum is created in the pumping chamber 40. With the valve 84 positioned in the motor mount 26 and/or the cap 44, such that the valve 84 is in fluidic communication between the ambient air and the pumping chamber 40 behind the diaphragm 42, the vacuum force created by the diaphragm 42 behind the diaphragm 42 may draw, pull, or otherwise force ambient air through the valve 84 and into the pumping chamber 40 behind the diaphragm 42.

Thereafter, in response to the armature 30 changing directions, as the diaphragm 42 moves away from the cap 44, or back toward the motor 20, the volume on the fluid side of the diaphragm 42 increases and the vacuum force created by the movement of the diaphragm 42 causes fluid to enter the pumping chamber 40 on the fluid side of the diaphragm 42 through one of the check valves 47 or 49 (depending on the flow direction of the fluid). Concurrently therewith, the volume on the backside of the diaphragm 42, which now contains ambient air, decreases and the resulting force of pressure on the ambient air from decreased volume forces or causes the ambient air to exit the pumping chamber 40 on the backside of the diaphragm 42 through the valve 86.

A similar description can be made for the interaction of the valves 84 and 86 with the diaphragm 52 and the pumping chamber 50. For example, as the diaphragm 52 flexes toward the cap 54 to reduce the volume of the pumping chamber 50 on the fluid side, in response to the movement of the armature 30, the fluid residing in the pumping chamber 50 is expelled from the pumping chamber 50, due to increased pressure from decreasing volume, through one of the check valves 47 or 49 (depending on the flow direction of the fluid) and into the manifold 60. Concurrently therewith, behind the diaphragm 52, on the opposite side 51 of the diaphragm 52 from the fluid, a vacuum is created in the pumping chamber 50. With the valve 84 positioned in the motor mount 26 and/or the cap 44, such that the valve 84 is in fluidic communication between the ambient air and the pumping chamber 50 behind the diaphragm 52, the vacuum force created by the diaphragm 52 behind the diaphragm 52 may draw, pull, or otherwise force ambient air through the valve 84 and into the pumping chamber 50 behind the diaphragm 52.

Thereafter, in response to the armature 30 changing directions, as the diaphragm 52 moves away from the cap 54, or back toward the motor 20, the volume on the fluid side of the diaphragm 52 increases and the vacuum force created by the movement of the diaphragm 52 causes fluid to enter the pumping chamber 50 on the fluid side of the diaphragm 52 through one of the check valves 47 or 49 (depending on the flow direction of the fluid). Concurrently therewith, the volume on the backside of the diaphragm 52, which now contains ambient air, decreases and the resulting force of pressure on the ambient air from decreased volume forces or causes the ambient air to exit the pumping chamber 50 on the backside of the diaphragm 52 through the valve 86.

Embodiments of the pump 10 may comprise the valve 86 being positioned on or configured in the motor mount 26 and/or the caps 44 and 54 so that any air passing through the valve 86 may be directed or focused toward, over, onto, or otherwise in contact with the heat dissipation fins 23. In such a configuration, the air exiting the valve 86 may be forced over, into, through, or on the heat dissipation fins 23 to effectuate forced convection heat transfer from the fins 23, instead of simple natural convection heat transfer. Such action is advantageous to the pump 10 because forced convection increases the heat transfer rate of the heat away from the pump 10, making the pump 10 run more efficiently. The reason for higher heat transfer rates in forced convection is because the hot air surrounding the heat dissipation fins 23 is immediately removed by the forced and directed flow of air from the valve 86.

Moreover, embodiments of the pump 10 may comprise the fins 23 being encased in a housing or the like. The housing may comprise openings 88 through which the ambient air exiting the valve 86 and passing over the fins 23 (as indicated by the arrow 92) may exit the housing. Further, a flow member 85 may be positioned together with the fins 23 to assist in the flow of the ambient air exiting the valve 86 out of the housing through the openings 88. The flow member 85 may have angled portions that effectuate the flow of the forced ambient air out of the openings 88.

Embodiments of the pump 10 may comprise one or more valves 84 and one or more valves 86 working together with the pumping chamber 40 and one or more valves 84 and one or more valves 86 working together with the pumping chamber 50. In this way, a plurality of valves 84 and 86 may be positioned strategically in the motor mount 26 and/or caps 44 and 54 to interact with the pumping chambers 40 and 50, respectively, to thereby increase the heat transfer efficiency of the pump 10 to thereby more effectively cool the pump 10. In some embodiments, each of the valves 84 may have a corresponding valve 86, such that valves 84 and 86 may work in pairs.

Figure 4:
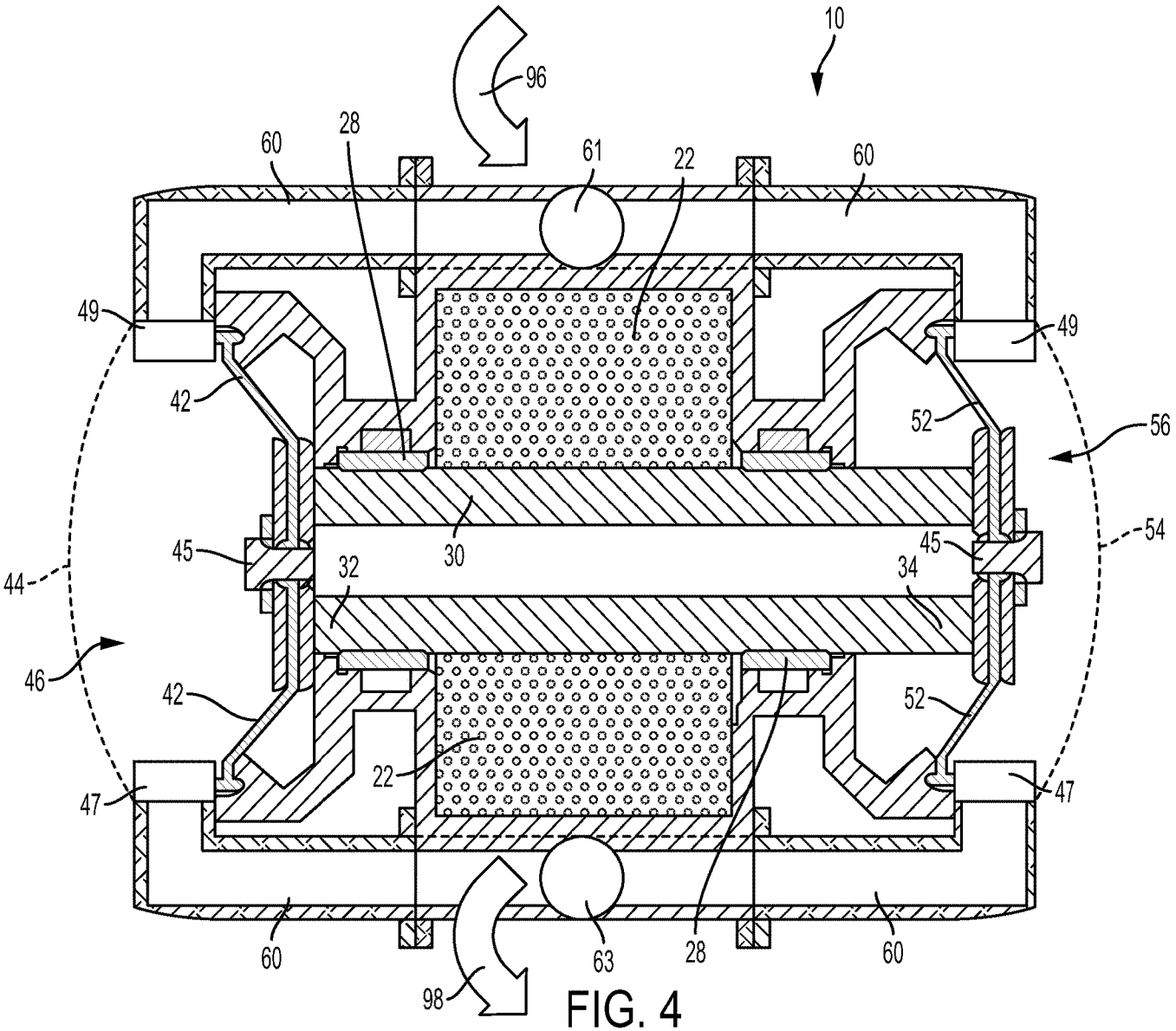
FIG. 4 is a cross-sectional side view of an illustrative embodiment of a linear motor double diaphragm pump in accordance with the present disclosure.

With regard to FIG. 4, embodiments of the pump 10 may comprise one or more conductive cooling features, such as the manifold 60. The manifold 60 may be configured to be in direct physical contact with the motor 20 to draw heat away from the stator 22. For example, the manifold 60 may be configured to directly contact the motor 20, at least at the locations where the manifold 60 crosses or approaches the motor, such that the fluid moving through the pump 10 via the manifold 60 and the pumping chambers 40 and 50 may pass over in direct contact with and draw heat away from the motor 20 by conduction. The manifold 60 may be configured to contact the exterior surface of the motor directly, such that the exterior surface of the manifold and the exterior surface of the motor are in contact with one another. Moreover, embodiments of the pump 10 may comprise the exterior surface of the manifold also functioning as the motor casing or the exterior surface of the motor, to effectuate more efficient heat transfer. The inlet 61 and outlet 63 portions of the manifold 60 may be positioned proximate the motor 20 to also facilitate heat transfer. The inlet 61 and outlet 63 portions may be switched or reversed, as needed, based on the needs of the pump 10.

The materials of construction of the pump 10 and its various component parts, including embodiments of the magnetic motor 20 and the respective pumping chambers, 40 and 50, may be formed of any of many different types of materials or combinations thereof that can readily be formed into shaped objects provided that the components selected are consistent with the intended operation of double-diaphragm pumps of the type disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described pump 10 and its various component parts, including embodiments of the magnetic motor 20 and the respective pumping chambers, 40 and 50, may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A diaphragm pump comprising:

a motor that drives an armature in a reciprocating linear motion, the armature having a first end;

a first diaphragm coupled to the first end of the armature, the first diaphragm positioned such as to form a first pumping chamber between the first diaphragm and a cap of the diaphragm pump, the first diaphragm configured to pump fluid into and out of the first pumping chamber in response to the reciprocating linear motion of the armature;

a cooling intake valve in operative communication with the first diaphragm; and a cooling exhaust valve in operative communication with the first diaphragm, wherein as the armature advances to flex the first diaphragm to decrease a volume of the first pumping chamber to pump fluid therefrom, the first diaphragm draws ambient air into a first cooling air chamber on an opposite side of the first diaphragm from the first pumping chamber, the ambient air drawn through the cooling intake valve, and wherein as the armature reverses course to cause the first diaphragm to increase the volume of the first pumping chamber to pump fluid therein, the first diaphragm forces ambient air out of the first pumping chamber behind the first diaphragm through the cooling exhaust valve such that the ambient air forced out of the first cooling air chamber is discharged to ambient after being routed through a flow path downstream of the cooling air chamber which is in direct thermal communication with the motor such that heat is rejected from the motor to the flow of ambient air in the flow path.

2. The pump of claim 1, further comprising fins coupled to the motor.

3. The pump of claim 2, wherein the cooling exhaust valve is oriented to direct ambient air toward the fins.

4. The pump of claim 3, wherein the cooling exhaust valve directs the ambient air exiting therefrom over the fins.

5. The pump of claim 1, further comprising a motor mount configured to support the motor in the pump, wherein the cooling intake valve and the cooling exhaust valve are configured in the motor mount.

6. The pump of claim 1, further comprising a plurality of cooling intake valves and a plurality of cooling exhaust valves, each of the cooling intake valves having a corresponding cooling exhaust valve.

7. The pump of claim 4, further comprising a second diaphragm coupled to a second end of the armature, the second diaphragm positioned such as to form a second pumping chamber between the second diaphragm and a second cap of the diaphragm pump, the second diaphragm configured to pump fluid into and out of the second pumping chamber in response to the reciprocating linear motion of the armature.

8. The pump of claim 7, further comprising a cooling intake valve and a cooling exhaust valve in operative communication with the second diaphragm.

9. The pump of claim 8, wherein as the armature advances to flex the second diaphragm to decrease a volume of the second pumping chamber to pump fluid therefrom, the second diaphragm draws ambient air into a second cooling air chamber on an opposite side of the second diaphragm from the second pumping chamber, the ambient air drawn through the cooling intake valve.

10. The pump of claim 9, wherein as the armature reverses course to cause the second diaphragm to increase the volume of the second pumping chamber to pump fluid therein, the second diaphragm forces ambient air out of the second cooling air chamber behind the second diaphragm through the cooling exhaust valve.

11. The pump of claim 10, wherein the first and second pumping chambers function inversely to one another.

12. The pump of claim 4, wherein the fins are oriented lengthwise along a length of the motor.

13. The pump of claim 12, wherein the fins are configured with a gap between neighboring fins and the cooling exhaust valve forces the ambient air exiting therefrom into the gaps.

14. The pump of claim 10, wherein the cooling intake valve is apart from an intake used to provide fluid to the first pumping chamber such that the ambient air used in the cooling air chamber originates from a different location that fluid provided to the first pumping chamber.

15. The pump of claim 10, wherein the fluid provided to the first pumping chamber is different from the ambient air provided to the first cooling chamber.

* * * * *